United States Patent [19]

Hogg, Jr. et al.

[11] 4,417,344

[45] Nov. 22, 1983

[54] COMPOSITE ELECTRODE FOR ARC FURNACE

[75] Inventors: Grady R. Hogg, Jr., Elizabethton; Nathan S. Tanner, Johnson City, both of Tenn.

[73] Assignee: Great Lakes Carbon Corporation, New York, N.Y.

[21] Appl. No.: 404,828

[22] Filed: Aug. 3, 1982

[51] Int. Cl.[3] ..... H05B 7/101; H05B 7/085

[52] U.S. Cl. ..... 373/93

[58] Field of Search ..... 373/91, 92, 93, 90

[56] References Cited

U.S. PATENT DOCUMENTS

| | | | |
|---|---|---|---|
| 1,408,418 | 2/1922 | Sperling | 373/93 |
| 3,368,019 | 2/1968 | De Corso et al. | 373/90 |
| 4,256,918 | 3/1981 | Schwabe | 373/93 |

*Primary Examiner*—Roy N. Envall, Jr.

*Attorney, Agent, or Firm*—Adrian J. Good

[57] ABSTRACT

A composite electrode for an arc smelting furnace comprising a water cooled aluminum upper clamped section 12, a hollow metal nipple 42, protected by refractory rings 46 in the unclamped area and a consumable graphite electrode 54.

7 Claims, 2 Drawing Figures

COMPOSITE ELECTRODE FOR ARC FURNACE

BACKGROUND OF THE INVENTION

1 Field of the Invention

The invention relates generally to an electrode for arc furnaces, and particularly to a composite electrode comprising a liquid-cooled non-consumable upper portion and a consumable tip portion joined to the upper portion by liquid-cooled connection means.

2 Description of the Prior Art

The conventional material employed for the fabrication of electrodes for arc furnaces is graphite. These electrodes are consumed in use due to erosion and corrosion caused by oxidation, vaporization, spalling and other factors. This consumption involves tip losses, column breakage losses and particularly side oxidation losses. An average electric furnace consumes four to eight kilograms of graphite per ton of steel produced.

One method for reducing the consumption of graphite electrodes in arc furnaces has been the application of a protective coating or cladding material to the electrodes with oxidation resistant materials. These coatings generally increase the contact resistance to the electrode clamp, and some are corrosive, as they are based on phosphoric acid. Consequently, they have not found wide acceptance.

Another means for reducing graphite electrode consumption involves the utilization of fully non-consumable electrode systems. The systems employ full length fluid-cooled electrodes with selected apparatus to protect the electrode tip from the extreme temperatures of the arc. Although such systems appear in patent literature, this design has not been commercially successful.

It has been suggested heretofore that composite electrodes comprising carbon or graphite portions attached to a water-cooled metallic piece would provide means for reducing electrode consumption in arc furnaces. A number of patents have issued on specific composite electrode designs. For example, U.S. Pat. Nos. 2,471,531 to McIntyre et al.; 3,392,227 to Ostberg; 4,121,042 and 4,168,392 to Prenn; 4,189,617 and 4,256,918 to Schwabe et al.; and 4,287,381 to Montgomery relate to liquid cooled composite electrodes for arc furnaces. Likewise, European patent applications by C. Conradty Nurnberg designated 50,682; 50,683; and 53,200 are directed to composite electrode configurations.

OBJECTS OF THE INVENTION

It is an objective of the invention to provide an improved composite electrode for arc furnaces.

It is a further objective of the invention to provide a composite electrode wherein consumption of the graphite portion is substantially reduced.

It is a still further objective of the invention to provide a composite electrode which is able to resist the harsh environment of an arc furnace and thereby have a long useful life.

SUMMARY OF THE INVENTION

The invention is essentially comprised of a metal tubing main structure with a hollow metal female socket attached at its lower end, cooling liquid inlet and outlet ports at its top end, a central cooling liquid supply reservoir cylinder occupying the majority of the internal volume of the main tube, terminated at its lower end by a header end plate having a port and tubing leading to the interior of a hollow nipple threaded into the socket. Cooling liquid enters the electrode through an inlet tube in the upper end plate, passing into the central reservoir, which acts as a water supply and heat sink, out of the tubing at the lower end into the hollow metal nipple. The coolant then passes back out of the nipple into a chamber above the nipple and below the lower end plate of the internal cylinder, through passages in the lower end plate, into the annulus between the internal cylinder and the tubular main structure and out of the electrode through outlet ports and tubing in the upper end plate. The preferred coolant is water, suitably treated to avoid scale deposition and corrosion by commercially available chemical and electrical treatment, not forming part of this invention.

The lower portion of the electrode is protected from radiant heat and electrical arc shorting by a series of graphite rings encircling the electrode. These are held in place by a metal retaining ring at the lower end of the female nipple socket fitting a notch in the lower inside diameter of the graphite rings. Each of these is loosely fitted, thus if the bottom one of these rings is damaged, the next one above will slip down on the tube to replace it.

All joints are welded, and where possible, are sealed with O-rings.

Figure 1:
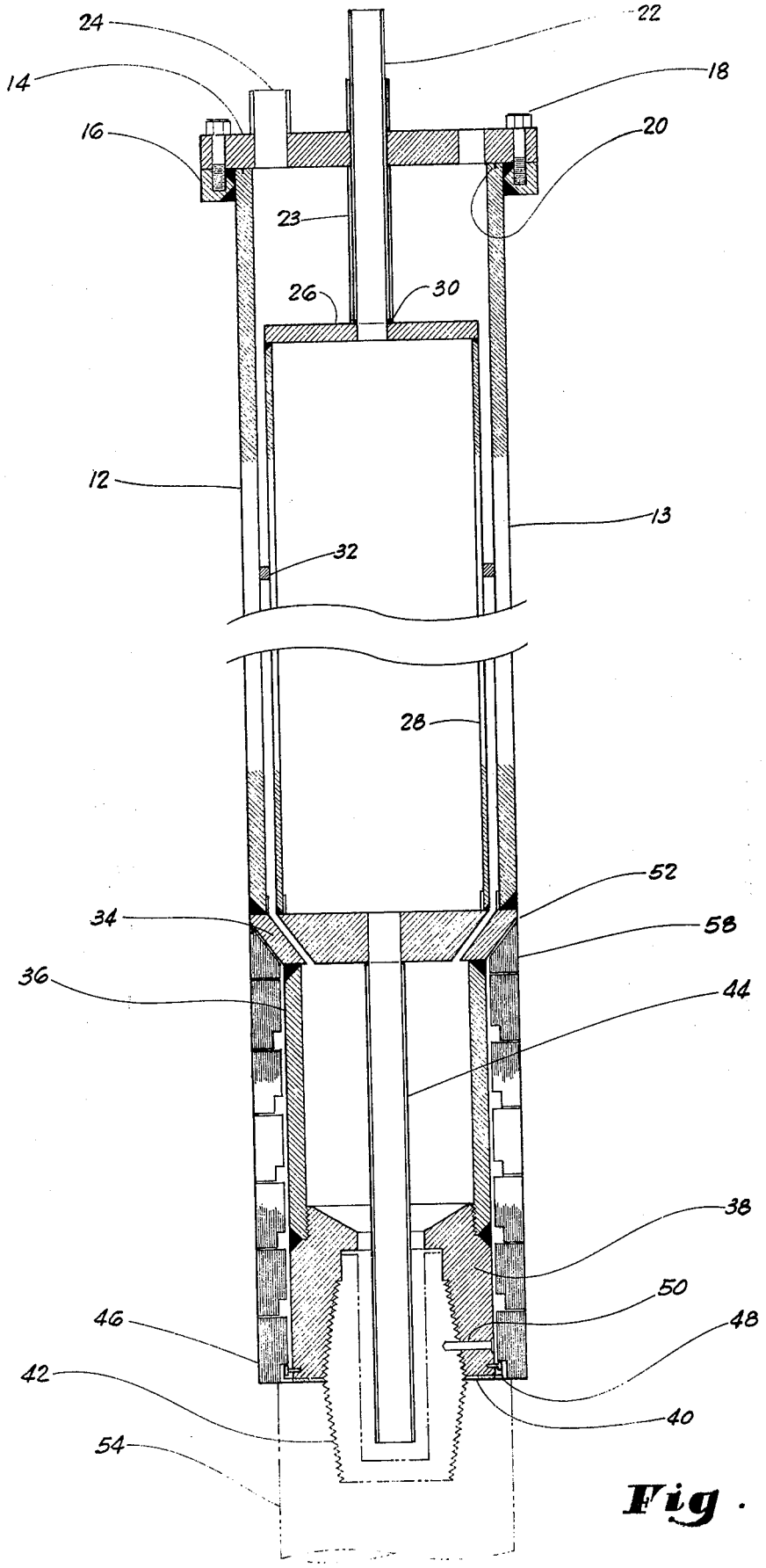
FIG. 1 shows main tubing 12, plated or metallized coating 13, upper end plate 14, retaining ring 16 welded to the outside wall of the main tube, plate retaining bolt 18, O-ring 20, coolant inlet tube 22, spacer tube 23, coolant pipe outlets 24, internal cylinder head plate 26, internal cylinder tube 28, O-ring 30, spacers 32, common lower end plate 34, main tube extension 36, cast aluminum nipple socket 38, explosion bonded copper socket plate 40, hollow copper nipple 42, lower coolant tubing 44, graphite rings 46, retaining ring 48, socket anchoring pin 50, insulating felt 52, graphite electrode 54 and the topmost beveled graphite ring 58.
Figure 2:
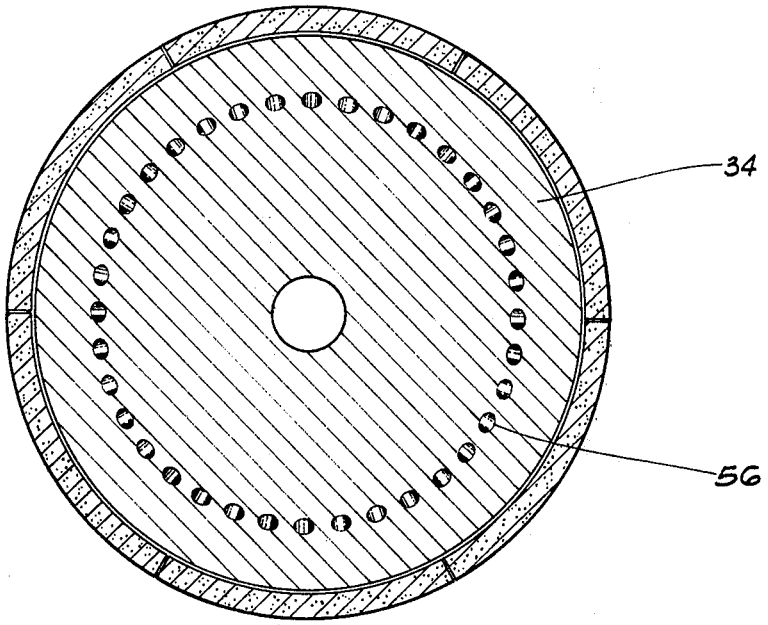

FIG. 2 is a cross-section of the common lower end plate 34 showing the angularly drilled water passages 56.

DETAILED DESCRIPTION OF THE INVENTION

The invention has as its main outer structure a single piece of heavy-walled metal tubing. This tubing must have sufficient mechanical strength to support the graphite lower section and must be able to withstand the mechanical stresses in the arc furnace where falling scrap, rough handling and mishandling are normal hazards, and must also transmit the arc current to the graphite electrode without excessive losses due to resistance heating. Aluminum alloy was used due to its favorable combination of conductivity and strength-weight ratio. It is also possible to use steel tubing, which introduces a severe penalty in resistance heating, or copper, which has an unfavorable strength-weight ratio. Another possible choice would be a copper-clad steel tube, possibly one made with an explosively bonded combination. Aluminum is the preferred material of construction. Other more exotic metals, e.g., titanium, might perform well but would be too expensive for this application.

A metallized or electroplated layer of a metal having a low contact resistance with the power clamp may be applied to the exterior of the main tube, to overcome the high contact resistance shown by aluminum due to the surface oxide always present. Metals useful as such coatings include silver, nickel, palladium, chromium, tungsten, tantalum and gold.

The upper end of the main tube has a heavy end plate featuring a coolant inlet and one or more outlets. A retaining ring for the end plate is welded (or it can be threaded) to the tubing and the joint is sealed with O-rings, as are all of the joints in the structure. In this instance the coolant inlet is a piece of tubing passing through a center port of the end plate continuing downwardly a relatively small distance until it joins a central internal cylinder having a relatively thin wall and occupying the major part of the volume of the main structure. This internal cylinder serves as part of the coolant supply and reservoir for coolant, as well as a heat sink for absorbed conductive and radiant heat. The internal cylinder is held firmly in place by spacers between it and the main structure wall, and at its lower end by spacers between the lower end plate or header and the nipple socket.

The main tube and the internal cylinder are terminated by weld joints to a common lower end plate of heavy aluminum. The outer diameter of this plate is the same as the outside diameter of the outer main tube, and is beveled at its periphery so that its lower face has a smaller diameter. A smaller diameter extension tube with the same outer diameter as the lower face of the beveled lower end plate is welded to the end plate. Passageways are drilled obliquely in the bottom plate approximately parallel to its beveled periphery to direct the coolant flow upward from the chamber above the nipple through the annulus between the two cylinders.

The main tube extension constitutes the lower part of the electrode which experiences the greatest heat, electrical, and mechanical stresses, and is below the range clamped during operation of the furnace.

The lower end of the main tube extension has a cast aluminum female nipple socket which has the same external diameter as the main tube extension and is solidly mounted thereto by a weld and by a threaded section engaging the correspondingly threaded inner wall of the lower end of the tubing. In this instance the nipple is machined from a hollow copper casting for good heat transfer. The nipple has a bi-frustro-conical shape; however, a straight sided nipple could be used since nipple breakage should not be a problem, as it is with graphite nipples, this nipple being permanent, or semi-permanent in comparison to graphite. The nipple is pinned into place in the socket with a radial pin.

The face of the nipple socket has a plate of copper explosively bonded in place to facilitate electrical conductivity across the interface between the upper metal section and the lower graphite electrode, although most of the current will pass through the copper nipple to the graphite electrode.

The lower end plate has a central cooling outlet tube which terminates inside the hollow nipple, with either an open end or with side openings to increase the flow velocity at the side walls.

The coolant enters the electrode through the top inlet, passes through the internal cylinder and into the nipple, and back up out of the nipple into the chamber between the nipple socket and the lower end plate, then through passageways or channels in the lower end plate into the annulus between the two cylinders and back out the outlet or outlets in the upper end plate.

The lower unclamped area of the electrode, being the main tube extension, is covered with a series of superimposed graphite rings which protect the socket area from radiation, slag, arc shorting, and mechanical damage during furnace operation. These rings are loose-fitting, have approximately the same outside diameter as the upper clamping section and are held in place by a retaining ring at the lower end of the socket, which fits a notch in the lower inner diameter of the rings. If the bottom ring, which is most likely to be damaged, falls off, the rings above it will slip down to protect the area of most danger. If an arc occurs between a piece of scrap and the composite electrode, the metal is protected against melting by the graphite rings, which diffuse the current and the heat produced.

The topmost graphite ring is beveled complementary to the lower end plate of the main tube, with the interface between the two beveled edges further protected by an inorganic fiber felt, either carbon or a silicate fiber such as Fiberfrax®, bonded in place by an inorganic high temperature-resistant adhesive.

I claim:

1. An electrode for an electric arc smelting furnace comprising an upper liquid cooled section, a hollow threaded connecting nipple, and a graphite lower section, (a) said upper section comprising:

1. a cylindrical main outer structure formed from metal tubing;
2. a head plate secured to the upper end of 1 having a cooling liquid inlet and outlet;
3. said inlet comprising tubing to be connected to an exterior liquid coolant supply and passing through said head plate, connected to a port in the top plate of a metal internal cylinder which is concentric with said main structure and separated therefrom by spacers;
4. said internal cylinder serving as a liquid reservoir, heat sink, and passageway for cooling liquid and occupying a majority of the internal volume of said main structure;
5. said main structure and said internal cylinder having a common lower end plate having a central cooling liquid port fitted with a outlet tube;
6. said lower outlet tube extending into the cavity of said nipple;
7. the periphery of said lower end plate being beveled;
8. cooling liquid passageways extending from top to bottom of said lower end plate approximately parallel to said bevel;
9. a cylindrical member comprising metal tubing defining a chamber depending from and having about the same diameter as the lower side of said lower end plate, and having attached thereto at its lower end a female socket for said nipple;
10. the socket and chamber areas being insulated by a series of superimposed exterior graphite rings having approximately the same interior diameter as the exterior of said socket and chamber and having about the same exterior diameter as said main structure, the top ring of said series being complementarily beveled to the beveled periphery of said lower end plate, each ring having a notch at its lower interior edge fitting a retaining ring attached to the exterior lower diameter of said socket;

11. said socket being hollow metal and having internal threads adapted to hold said correspondingly threaded nipple in place;

12. said inlet, internal cylinder, lower outlet tube, the annulus between said lower outlet tube and said nipple, said chamber, said passageways, the annulus between said main structure and said internal cylinder, and said outlets forming a continuous path for cooling liquid.

2. The electrode of claim 1 wherein the metal of construction in the upper section is aluminum.

3. The electrode of claim 1 wherein the main tube is coated with a metal effective to provide a lower electrical contact resistance with the power clamp than the uncoated metal tube.

4. The electrode of claim 3 wherein the coating metal is selected from the group consisting of silver, nickel, palladium, chromium, tungsten, tantalum, and gold.

5. The electrode of claim 1 wherein the nipple is copper.

6. The electrode of claim 1 wherein the member 9 is internally threaded at its lower end to engage corresponding threads on the top portion of the exterior of the socket.

7. The electrode of claim 1 wherein the nipple is held in place after assembly by a radial pin.

* * * * *